US007942260B1

(12) United States Patent
Rodriguez

(10) Patent No.: US 7,942,260 B1
(45) Date of Patent: May 17, 2011

(54) CUP INSERT WITH FOOD HOLDER

(76) Inventor: Otto M Rodriguez, Miami, FL (US)

( * ) Notice: Subject to any disclaimer, the term of this patent is extended or adjusted under 35 U.S.C. 154(b) by 63 days.

(21) Appl. No.: 12/604,675

(22) Filed: Oct. 23, 2009

(51) Int. Cl.
*B65D 81/00* (2006.01)

(52) U.S. Cl. ..... 206/217; 426/110; 426/115; 426/120; 220/23.83; 220/23.86

(58) Field of Classification Search ..... 206/217, 206/541, 549, 216; 426/86, 110, 115, 112, 426/120, 132, 124, 78, 79; 220/23.83, 23.86, 220/528, 556
See application file for complete search history.

(56) References Cited

U.S. PATENT DOCUMENTS

| | | | | | |
|---|---|---|---|---|---|
| 908,706 | A | | 1/1909 | Sprinkle | |
| 4,324,338 | A | | 4/1982 | Beall | |
| 4,923,702 | A | * | 5/1990 | Powell et al. | 220/521 |
| 5,137,210 | A | | 8/1992 | Hibbs | |
| 5,584,388 | A | * | 12/1996 | Johnson | 206/217 |
| 5,722,558 | A | * | 3/1998 | Thompson | 220/521 |
| 5,954,195 | A | * | 9/1999 | Krueger et al. | 206/217 |
| 6,022,570 | A | | 2/2000 | Richmond | |
| 6,209,748 | B1 | * | 4/2001 | Dunbar | 220/521 |
| 6,360,885 | B1 | * | 3/2002 | Krueger et al. | 206/217 |
| 6,419,153 | B1 | * | 7/2002 | Maita | 229/400 |
| 6,425,480 | B1 | * | 7/2002 | Krueger et al. | 206/217 |
| 7,156,229 | B2 | * | 1/2007 | Gordon et al. | 206/308.1 |
| 7,686,161 | B2 | * | 3/2010 | Simmons | 206/217 |
| 2004/0050847 | A1 | * | 3/2004 | Yoon | 220/212 |
| 2004/0149755 | A1 | * | 8/2004 | Olivar | 220/212 |
| 2004/0238381 | A1 | * | 12/2004 | Rademaker | 206/216 |
| 2004/0238538 | A1 | * | 12/2004 | Cosentino | 220/23.83 |

* cited by examiner

*Primary Examiner* — David T Fidei
(74) *Attorney, Agent, or Firm* — David Kiewit

(57) ABSTRACT

A sanitary single-use container for both food (e.g., an individual portion of bread) and drink (e.g., an individual portion of wine or grape juice) is designed to be placed over the mouth of a chalice, as may used in a communion service. The container is compatible with any chalice having a diameter and a wall thickness lying within conventional ranges of values. The container has a skirt portion that, in use, extends far enough down over a side wall of the chalice that someone drinking from the container does not touch the chalice with his or her lip. A sealed, but easily opened, food packet is attached to the skirt.

2 Claims, 4 Drawing Sheets

CUP INSERT WITH FOOD HOLDER

BACKGROUND INFORMATION

Sharing a common drinking vessel has long been recognized as an unsanitary practice. But sharing a common cup has long been a part of the Christian rite of communion in which bread and wine are shared among communicants.

Some Christian denominations have resolved this dilemma by providing a separate drinking vessel for each communicant. Of particular note in this regard are U.S. Pat. Nos. 4,324,338 to Beall and 6,022,570 to Richmond. Both of those inventors teach the use of multi-compartmented sealed containers for holding a single serving of a liquid (i.e., wine or grape juice) and a single serving of bread.

Other Christian denominations, however, demand or prefer the use of common cup in the rite of communion. Apparatus for common cup communion has been taught by Sprinkle, in U.S. Pat. No. 908,706, who provided disposable lip guards combined with a chalice designed to dispense individual liquid portions and store unconsumed liquid in a sump.

In view of the foregoing, it should be clear that there has been a longstanding and unsatisfied need for a sanitary means of dispensing wine and bread in a common cup ritual.

BRIEF SUMMARY OF THE INVENTION

One aspect of the invention is that it provides a container for both food (e.g., an individual portion of bread) and drink (e.g., an individual portion of wine or grape juice). The container is designed to be receivable within a cup or chalice that has a diameter and a wall thickness lying within conventional ranges of values. The container comprises a drink-receiving receptacle portion depending from, and preferably integrally formed with, a generally circular cover portion that fits entirely across the mouth of any cup or chalice having dimensions within the conventional range. The receptacle is spaced apart from the periphery of the cover portion by at least the maximum wall thickness value and is generally eccentrically located on the cover portion. The container further has a skirt portion depending from a periphery of the cover. The skirt portion is long enough to ensure that a communicant's lip does not touch an outer sidewall of the cup or chalice. In addition, the skirt portion has a sealed packet containing a piece of food (e.g., a piece of bread or a communion wafer) attached to it.

Another aspect of the invention is that it provides apparatus comprising, in combination, a cup or chalice and at least one individually usable container comprising a food portion within a sealed packet. The chalice has a generally circular mouth and a selected chalice volume. The container comprises a receptacle portion, a cover portion, and a skirt portion. The receptacle portion has a receptacle volume substantially less than the chalice volume, and is intended to receive an individual liquid serving. The receptacle portion depends from, and may be integrally formed with, a generally circular cover portion extending across the mouth of the chalice. The skirt portion depends downwardly along a sidewall of the chalice from a periphery of the cover portion and has a food packet containing a piece of food, attached to its outer wall.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all of the recited features and advantages may be provided by some embodiments.

DETAILED DESCRIPTION OF A PREFERRED EMBODIMENT

In studying this Detailed Description, the reader may be aided by noting definitions of certain words and phrases used throughout this patent document. Wherever those definitions are provided, those of ordinary skill in the art should understand that in many, if not most instances, such definitions apply to both preceding and following uses of such defined words and phrases. At the outset of this Description, one may note that the terms "include" and "comprise," as well as derivatives thereof, mean inclusion without limitation; the term "or," is inclusive, meaning and/or. In particular, the terms 'cup' and 'chalice' will be used interchangeably herein to refer to a drinking vessel having a generally circular mouth.

Figure 1:
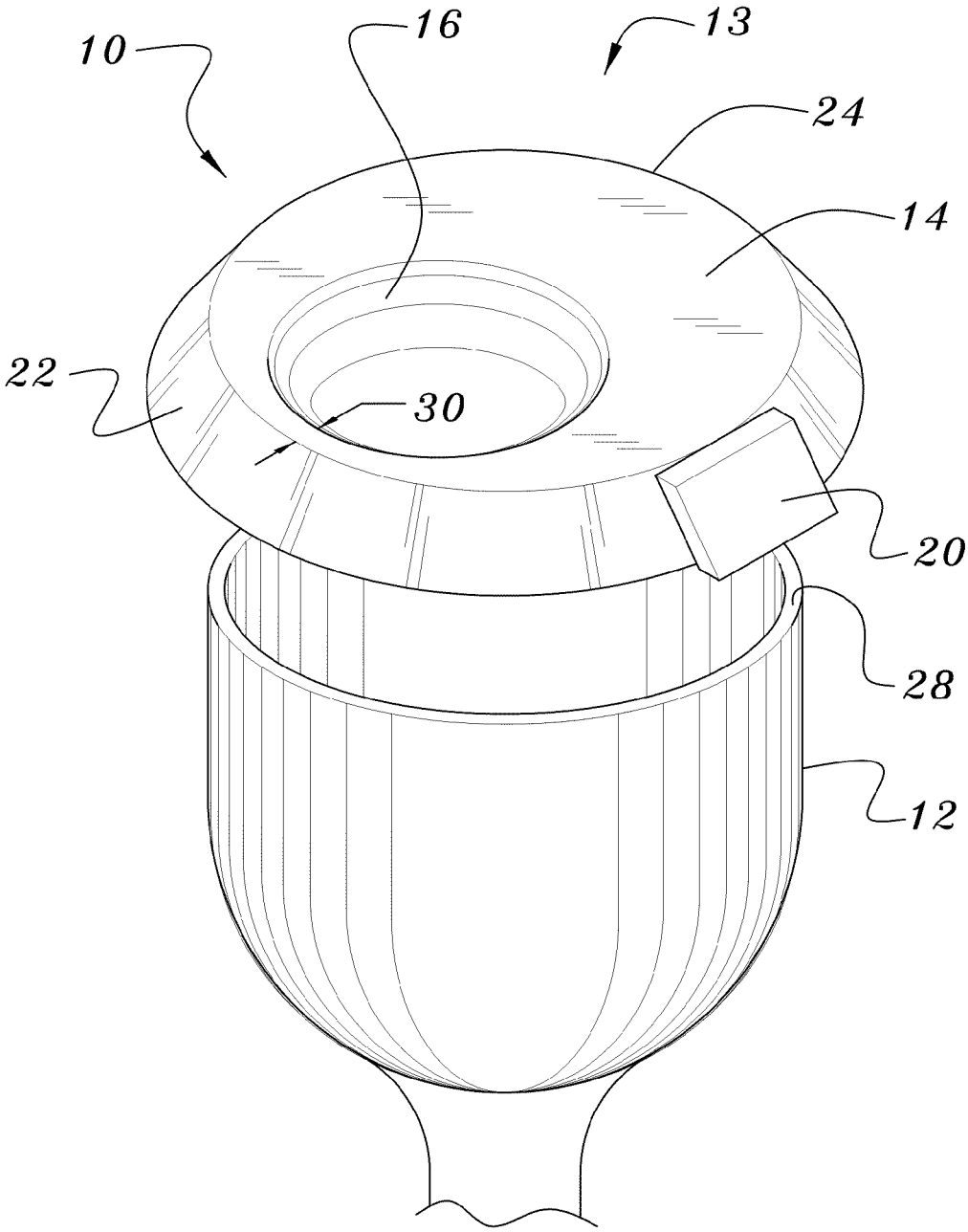
FIG. 1 is an exploded view of a relatively large chalice and a single-use food and drink container receivable therein.

Turning now to FIG. 1, one finds a depiction of a food and drink dispensing apparatus 10 comprising a cup 12 or chalice and a container 13 comprising a cover 14 having a receptacle 16 that may receive a liquid 18. The container 13 also comprises a sealed food packet 20 preferably attached to a skirt 22 that extends around a periphery 24 of the cover 14.

Chalices are available in a wide variety of sizes and designs. Many of these are quite ornate and expensive. The chalice 12 is expected to be a pre-existing and uncontrolled element of the overall apparatus of the invention. Thus, the individual-use container 13 is preferably configured to be usable with a large fraction of chalices that are already in use. In order to do this, ranges of both the diameter and wall thickness of chalices need to be considered.

It is believed that the great majority of chalices in use today have circular mouths with diameters ranging from about 80 mm to about 130 mm. Thus, one can configure a container 13 comprising a receptacle portion 16 sized to fit within an 80 mm chalice mouth. The circular cover portion 14 is designed so that its periphery 24 extends outward far enough to reach beyond an outer surface 26 of a chalice 12*b* characterized by a maximum diameter value, which is selected in this case to be 130 mm. In order for the container of the invention to be usable any chalice having a diameter within a conventional range of diameters of greater than 150%, a preferred container 13 comprises a relatively small receptacle disposed eccentrically within a relatively large cover portion.

Figure 4:
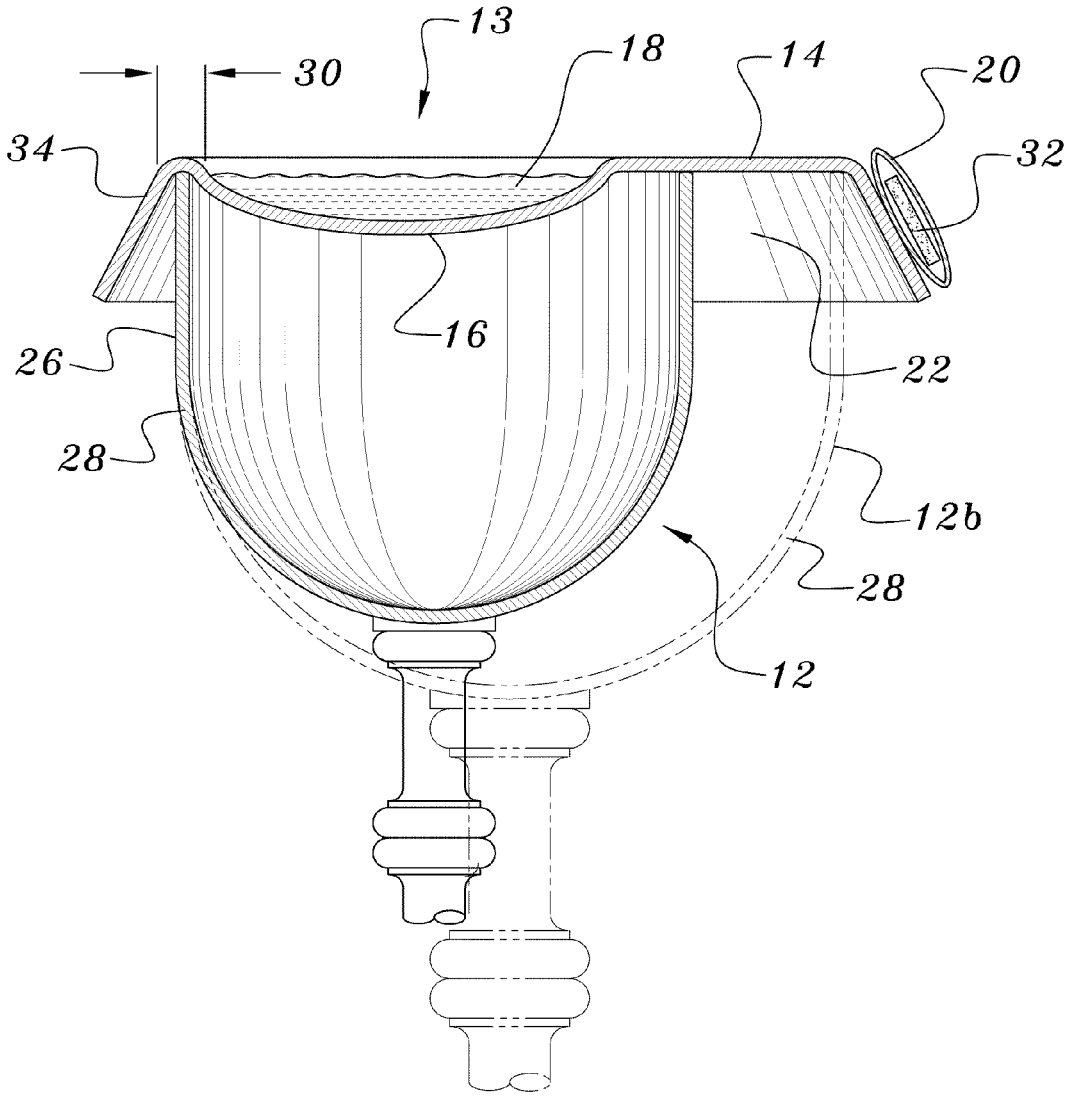
FIG. 4 is a sectional view of the container of FIG. 2, the section taken as indicated by the double-headed arrow 4-4 in FIG. 2.

The thickness of a wall 28 of a chalice is another parameter to be considered. Many chalices are made of precious metals (e.g., silver) and have a relatively thin wall on the order of 1 mm or so in thickness. On the other hand a maximum wall thickness value of 5-6 mm may be encountered in a chalice made of earthenware. In order to accommodate a range of chalice wall thicknesses the container 13 is preferably configured so that the receptacle portion 16 is spaced away from the skirt 22 by a distance, indicated with a double-headed arrow 30 in FIG. 2 and FIG. 4, to accommodate the selected maximum wall thickness.

Figure 2:
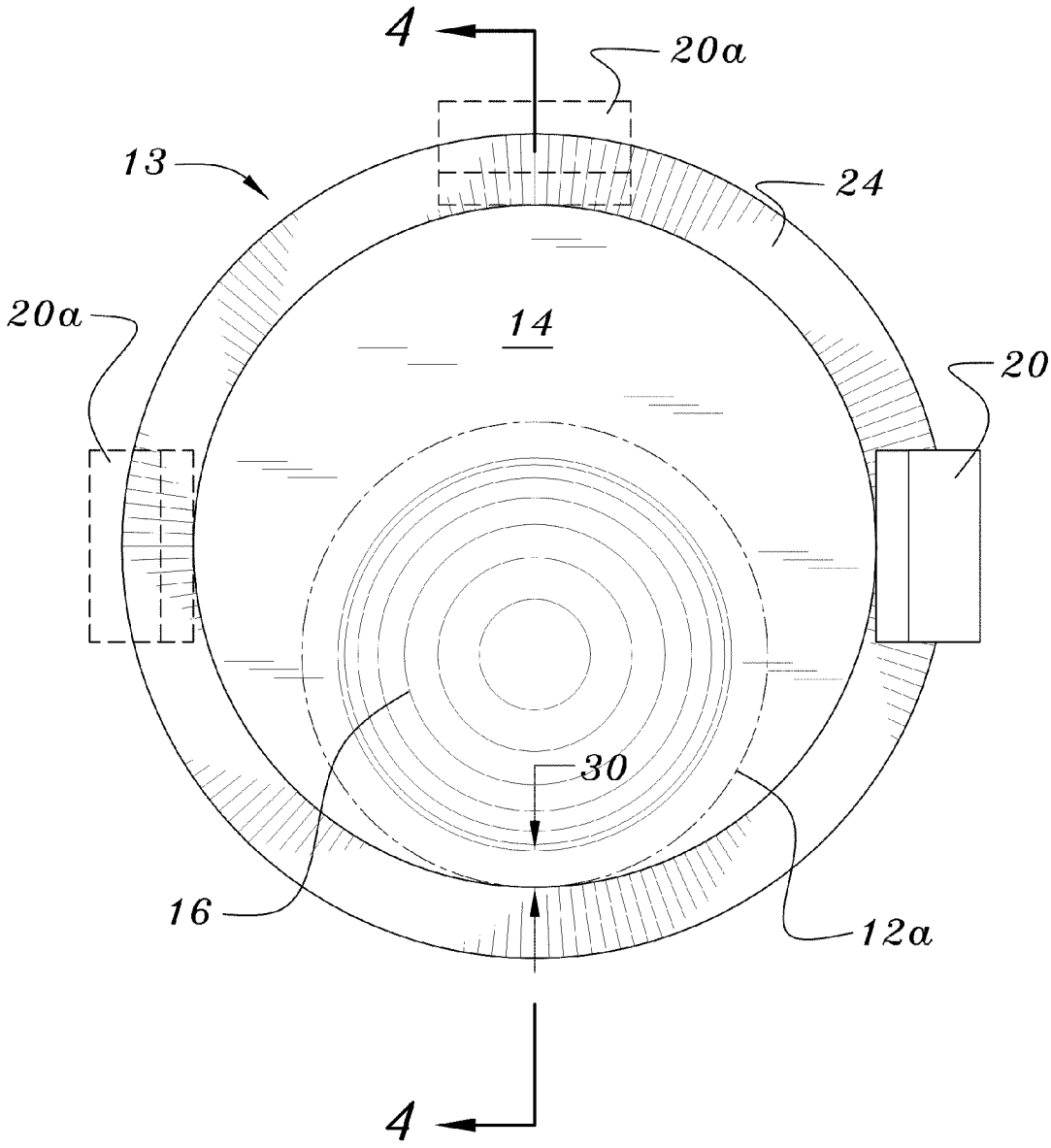
FIG. 2 is a plan view of a single-use food and drink container of the invention.
Figure 3:
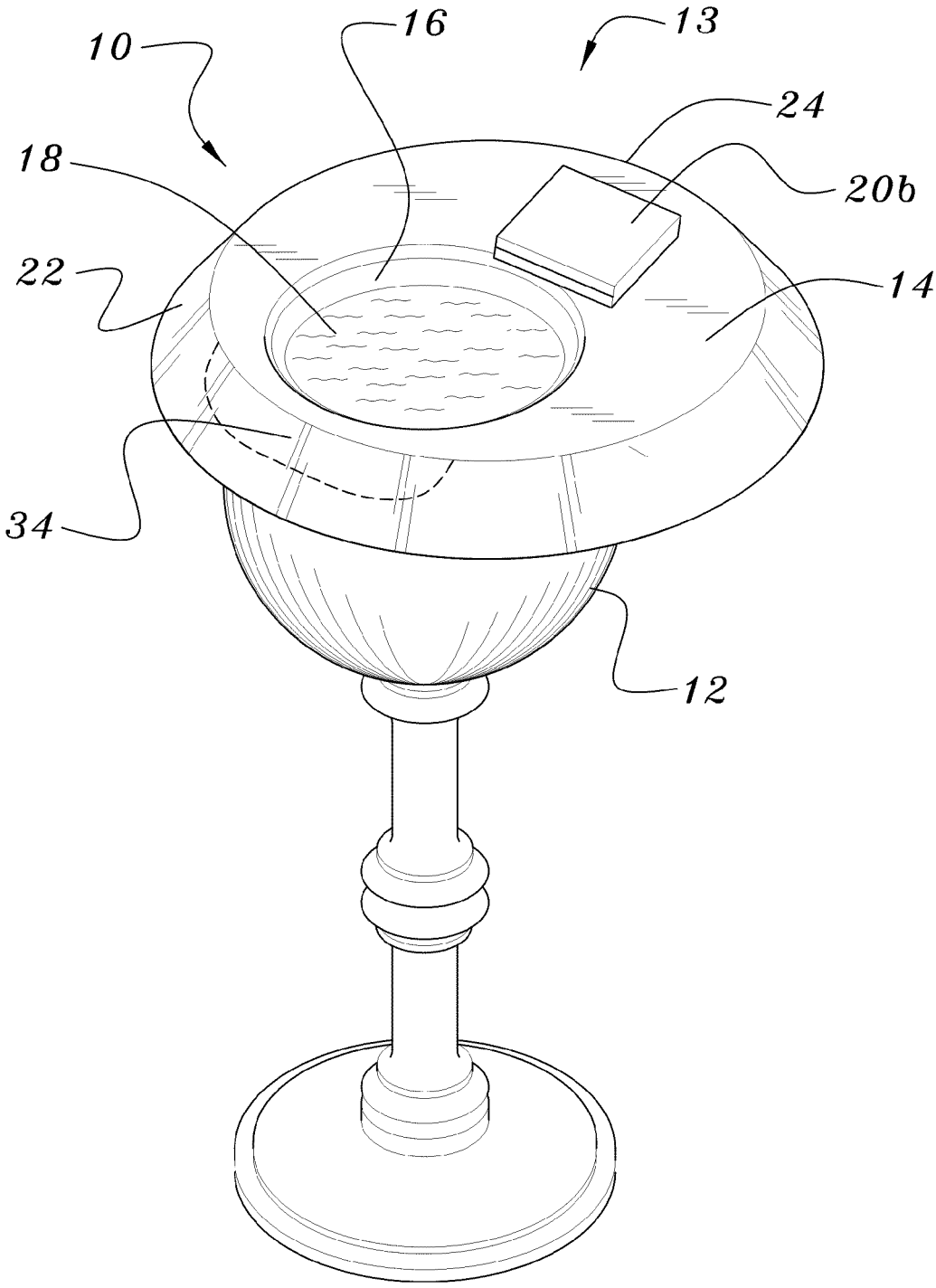
FIG. 3 is a perspective view of a single-use food and drink container placed on a relatively small chalice.

If the spacing 30 between the receptacle 16 and skirt 22 is too large, drinking from the receptacle without spilling the liquid becomes difficult. Thus, the preferred container 13 has a receptacle 16 eccentrically disposed with respect to the periphery 24 of the cover 14. As depicted in FIG. 2, when a small cup or chalice 12*a* (depicted in phantom beneath the cover 14), is used, the receptacle fits symmetrically within it. But, when the preferred container 13 is used with a large chalice 12*b*, as depicted in FIG. 3, the receptacle is eccentrically disposed within the mouth of the chalice as well as being eccentrically disposed with respect to the cover portion.

The skirt 22 preferably depends far enough below the cover portion 14 so that a communicant's lower lip contacts a portion 34 of the skirt, rather than touching the outer surface 26 of the chalice 12. It is recognized that a longer skirt may be desired as a matter of appearance, or to provide better support for a food packet 20 adhered to a portion of the outer surface of the skirt 22. Moreover, although the skirt is depicted as being generally uniform around the periphery of the cover, it should be recognized that this is not a necessary feature and that the skirt length may vary along the periphery of the cover.

In a preferred embodiment, the skirt 22, cover 14, and receptacle 16 are integrally formed from a single polymeric body. The reader should recognize that many other choices of material and fabrication method are within the scope of the invention. For example, one could choose to use a paper material and to wax, or otherwise seal, the inner portion of the receptacle and the portion of the cover and skirt that a communicant's lip would be expected to contact.

The container 13 comprises a sealed food packet 20 that is preferably attached to an outer surface of the skirt 22 by any suitable means, such as adhesive bonding or heat sealing. The packet is preferably designed to be easily detached from the rest of the container 13 and be easily torn open by a communicant. The reader will recognize that there are many different ways of providing such a packet that are used within the packaged food industry and that the present invention is not restricted to any particular one of them. In a particular preferred embodiment the packet is formed with a cylindrical radius so as to fit the skirt to which it is attached.

The packet 20 contains a piece of food 32, which is generally a piece of bread or an unbaked, unleavened wafer. In some embodiments, the piece of food may be specially shaped to fit around the outside of the skirt 22. For example, one could configure a wafer having a cylindrical radius of curvature matching that of the skirt.

It is expected that a plurality of single use containers 13 will be supplied stacked in a suitable box or the like. If all the containers have a food packet attached at essentially the same location along the respective skirts, stacking may be difficult. In order to avoid this problem, one may choose to make several otherwise similar containers having respective food packets attached at different positions 20*a*, as depicted in phantom in FIG. 2. Alternately, a food packet 20*b* can be attached to the top of a cover portion 14 of the container, as depicted in FIG. 3, rather than to the skirt.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A container for food and drink, the container receivable within any of a plurality of cups having a diameter no less than a minimum diameter value and no greater than a maximum diameter value and a wall thickness no greater than a maximum thickness value, the container comprising:

a drink-receiving receptacle portion depending from a generally circular cover portion having a skirt portion depending from a periphery thereof, wherein:

the cover portion has a diameter substantially equal to the maximum diameter value;

the drink receiving receptacle portion is spaced apart from the periphery of the cover portion by at least the maximum wall thickness value; and a sealed packet containing a piece of food is attached to the skirt portion and is shaped to fit thereagainst.

2. A container for food and drink, the container receivable within any of a plurality of cups having a diameter no less than a minimum diameter value and no greater than a maximum diameter value and a wall thickness no greater than a maximum thickness value, the container comprising:

a drink-receiving receptacle portion depending from a generally circular cover portion having a skirt portion depending from a periphery thereof, wherein:

the cover portion has a diameter substantially equal to the maximum diameter value:

the drink receiving receptacle portion is spaced apart from the periphery of the cover portion by at least the maximum wall thickness value; and a sealed packet containing a piece of food is attached to the skirt portion at one of a plurality of selected positions, whereby the container is adapted to be stacked on a second container having a respective sealed packet attached to a respective skirt at a second of the plurality of positions.

* * * * *